US006997433B2

(12) United States Patent
Koneda et al.

(10) Patent No.: US 6,997,433 B2
(45) Date of Patent: Feb. 14, 2006

(54) ELECTRONIC VALVE ACTUATOR HAVING VIBRATION CANCELLATION

(75) Inventors: Philip Koneda, Novi, MI (US); Thomas Megli, Dearborn, MI (US); Michael Degner, Novi, MI (US); James Ervin, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 140 days.

(21) Appl. No.: 10/761,744

(22) Filed: Jan. 21, 2004

(65) Prior Publication Data

US 2005/0156697 A1 Jul. 21, 2005

(51) Int. Cl.
*F16K 31/00* (2006.01)

(52) U.S. Cl. ..... 251/129.2; 251/129.1; 251/129.16; 251/129.19; 251/14; 123/90.11; 123/90.12; 123/90.49

(58) Field of Classification Search ..... 251/129.1, 251/129.09, 129.01, 129.15, 129.16, 129.19, 251/129.2, 14, 30.01; 123/90.11, 90.12, 123/90.49

See application file for complete search history.

(56) References Cited

U.S. PATENT DOCUMENTS

| | | | | |
|---|---|---|---|---|
| 3,108,777 | A * | 10/1963 | Ray | 251/54 |
| 3,548,793 | A | 12/1970 | Richardson | |
| 3,683,962 | A * | 8/1972 | Good | 137/868 |
| 4,268,009 | A * | 5/1981 | Allen, Jr. | 251/129.2 |
| 4,285,497 | A * | 8/1981 | Gottel | 251/129.2 |
| 5,119,773 | A | 6/1992 | Schon et al. | |
| 5,161,494 | A | 11/1992 | Brown, Jr. | |
| 5,799,696 | A * | 9/1998 | Weiss | 137/625.44 |
| 6,192,841 | B1 | 2/2001 | Vorih et al. | |
| 6,202,607 | B1 | 3/2001 | Kreuter | |
| 6,262,498 | B1 | 7/2001 | Leiber | 310/12 |
| 6,325,028 | B1 | 12/2001 | Albanello et al. | |
| 6,772,919 | B1 * | 8/2004 | Magri | 222/504 |
| 2003/0160197 | A1 * | 8/2003 | Kodama | 251/57 |
| 2005/0155564 | A1 * | 7/2005 | Koneda et al. | 123/90.11 |

FOREIGN PATENT DOCUMENTS

| | | |
|---|---|---|
| EP | 0 970 299 | 12/2000 |
| EP | 0970295 | 6/2001 |
| EP | 0970299 | 6/2001 |
| JP | 2223612 | 6/1990 |

* cited by examiner

*Primary Examiner*—J. Casimer Jacyna
(74) *Attorney, Agent, or Firm*—Julia Voutyras; Richard M. Sharkansky; Allan J. Lippa

(57) ABSTRACT

An electronically controlled valve actuator having an armature, a valve, and a coupler for coupling the actuator to the valve with motion of the armature in a first direction moving the second piston in a second direction. The actuator includes an electromagnet, an armature disposed adjacent to the electromagnetic, and a fluid-containing chamber. The fluid-containing chamber includes a first piston providing a first wall portion of the chamber and a second piston providing a second wall portion of the chamber. The first piston is coupled to the armature and the second piston is coupled to a valve. Activation of the electromagnet moves the first piston in a first direction, such motion of the first piston in the first direction driving fluid in the chamber to move the second piston in an opposite direction.

11 Claims, 4 Drawing Sheets

ELECTRONIC VALVE ACTUATOR HAVING VIBRATION CANCELLATION

TECHNICAL FIELD

This invention relates generally to electronic valve actuators (EVAs) and more particularly to electronic valve actuators having vibration cancellation.

BACKGROUND

As is known in the art, one common approach to electronically control the valve actuation of an internal combustion engine is to have two electromagnets toggle an armature connected to the valve between an open position and a closed position. More particularly, referring to FIG. 1, when a first, here upper, one of the electromagnets is activated, the armature is attracted to the activated electromagnet thereby driving the valve to its closed position. Also, as the armature is attracted to the activated electromagnet, a first spring, in contact with the upper end of the armature is compressed. When the first electromagnet is deactivated, the first compressed spring releases it stored energy and drives the armature downward thereby driving the valve towards it open position. As the armature approaches the second, lower electromagnet, the second electromagnet is activated driving the valve to its full open position. It is noted that a second, lower spring becomes compressed during the process. After being fully open for the desired period of time, the second electromagnet is deactivated, and the lower spring releases its stored energy and thereby drives the armature towards its upper position, the first electromagnet is activated and the process repeats. Thus, the two electromagnets toggle the armature connected to the valve between an open or closed position where it is held, while the pair of springs is used to force the valve to move (oscillate) to the other state (FIG. 1).

One problem with the approach described above is that, because the armature and the valve both move, or stroke, in the same direction, a net force is produced on the engine during such stroke. The net force produced during an up-stroke is opposite to the net force produced during a down-stroke. These net upward-downward forces result in undesirable engine vibrations.

SUMMARY

In accordance with the present invention an electronic valve actuator is provided having an armature, a valve, and a coupler for coupling the actuator to the valve with motion of the armature in a first direction while moving the valve in a second direction.

With such an arrangement, because the armature and the valve both move, or stroke, in opposite directions undesirable engine vibrations are reduced.

In one embodiment, the actuator includes an electromagnet, an armature disposed adjacent to the electromagnetic, and a fluid-containing chamber. The fluid-containing chamber includes a first piston providing a first wall portion of the chamber and a second piston providing a second wall portion of the chamber. The first piston is coupled to the armature and the second piston is coupled to a valve. Activation of the electromagnet in a moves the first piston in a first direction, such motion of the first piston in the first direction driving fluid in the chamber to move the second piston in an opposite direction.

In one embodiment, the electronic valve actuator includes a pair of electromagnets. The armature is disposed in a magnetic field produced by the pair of electromagnets. A pair of springs is included. The armature, and hence the first one of the pair of pistons, are disposed to move in the first direction upon activation of a first one of the pair of electromagnets thereby compressing a first one of the pair of springs. Movement of the first one of the pair of pistons in the first direction causes fluid to move the second one of the pistons in the second direction thereby expanding the second one of the pair of springs. The first and second springs are held in compression and expansion, respectively, until deactivation of the first one of the electromagnets. The first one of the pair of springs is disposed to expand after deactivation of the first one of the electromagnets thereby forcing the first one of the pair of pistons to move in the second direction. Movement of the first one of the pistons in the second direction results in fluid in the chamber forcing the second piston to move in the first direction resulting in expansion and compression of the first and second springs, respectively. The first and second springs are held in expansion and compression, respectively, until deactivation of the second of the pair of electromagnets.

In one embodiment, the first wall portion of the first one of the pair of pistons has a surface area different from the surface area of the second wall portion of the second one of the pair of pistons.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 2:
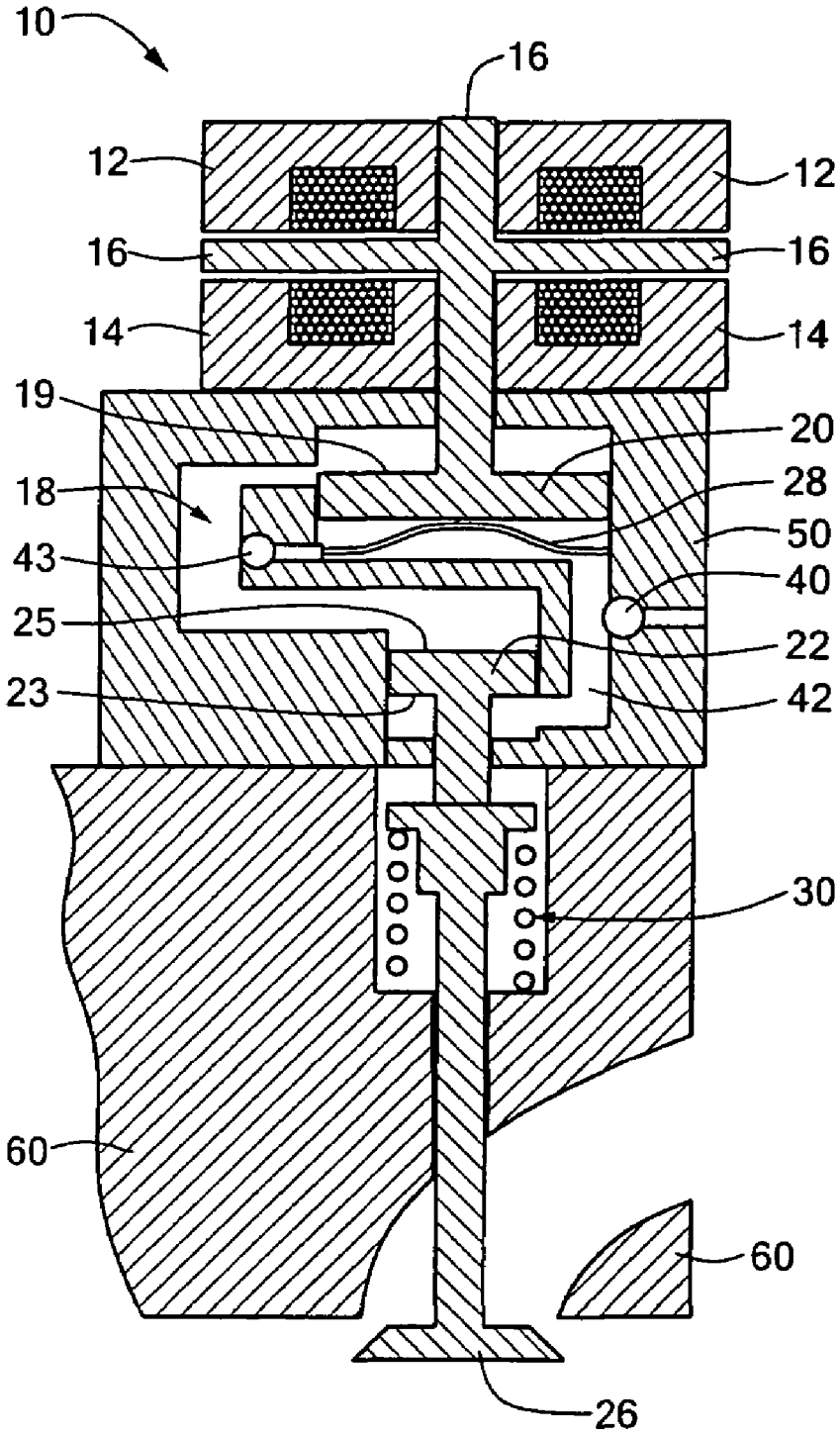
FIG. 2 is an electronic valve actuator according to the invention.

Referring now to FIG. 2, an electronic valve actuator 10 is shown to include a pair of electromagnets 12, 14. An armature 16 is disposed in a magnetic field, not shown, produced by the pair of electromagnets 12, 14. The actuator 10 also includes a left fluid-containing chamber 18, herein also referred to as left inner cavity 18, and right fluid-containing chamber 42, herein also referred to as right inner cavity 42. The left inner cavity 18 has a first piston 20 providing a first wall portion of the left inner cavity 18 and a second piston 22 providing a second wall portion of the left inner cavity 18, as shown. The right inner cavity 42 has a first piston 20 providing a first wall portion of the right inner cavity 42 and a second piston 22 providing a second wall portion of the right inner cavity 42, as shown. The first wall portion provided by first piston 20 is greater in surface area (A1) than the surface area (A2) provided by the second wall portion provided by the second piston 22. The first piston 20 is coupled to the armature 16, here integrally formed as a single piece with the armature 16, and the second piston 22 is coupled to a valve 26, here integrally formed as a single piece with the valve 26. The actuator 10 also includes a pair of springs 28, 30.

The first, armature piston 20 is biased with the upper, armature spring 28, here a Belleville spring, to be held in a normally upward position while the lower, valve piston 22 is attached to the valve 26 and biased with the lower, valve coil spring 30 in a normally upward position.

During normal operation, activation of the upper electromagnet 12 causes a plate 17 of armature 16, and hence the upper piston 20, to move upward. This upward motion decompresses spring 28. As a result of the upward movement of the upper piston 20, fluid in the left inner-cavity 18 increases in pressure to ensure seating of check valve 43. This higher pressure fluid on the upper side 25 of the lower piston 22 causes the lower piston 22, and hence valve 26, to move downward. The downward movement of the lower piston 22 results in compression of the lower spring 30. The upper and lower springs 28, 30 are held in expansion and compression, respectively, until deactivation of the upper electromagnet 12.

After deactivation of the upper electromagnet 12, the lower spring 30 expands resulting in an upward movement of the lower piston 22. This upward movement of the lower piston 22 causes fluid in left inner-cavity 18 to reduce in pressure forcing the upper piston 20 and armature 16 downward while also compressing the upper spring 28. The upper and lower springs 28, 30 are held in compression and expansion, respectively, by activation of the lower electromagnet 14.

Here, the first wall portion 19 of upper piston 20 has a greater surface area than the surface area of the second wall portion 25 provided by the lower piston 22.

More particularly, a valve 40, here a check valve is disposed in the wall of the housing 50 for enabling the right inner chamber or cavity 42 to receive fluid, here hydraulic fluid of the internal combustion engine, not shown, when the pressure in right inner cavity 42 is less than the hydraulic fluid pressure of the internal combustion engine. The check valve 40 is disposed to inhibit removal of such fluid from the cavity chamber 18.

More particularly, the upper hydraulic piston 20 is attached to the armature 16 and is biased with the upper (armature) spring 28 to be urged in an upward position while a lower piston 22 is attached to the valve 26 and biased in an upward position by spring 30.

Figure 3B:
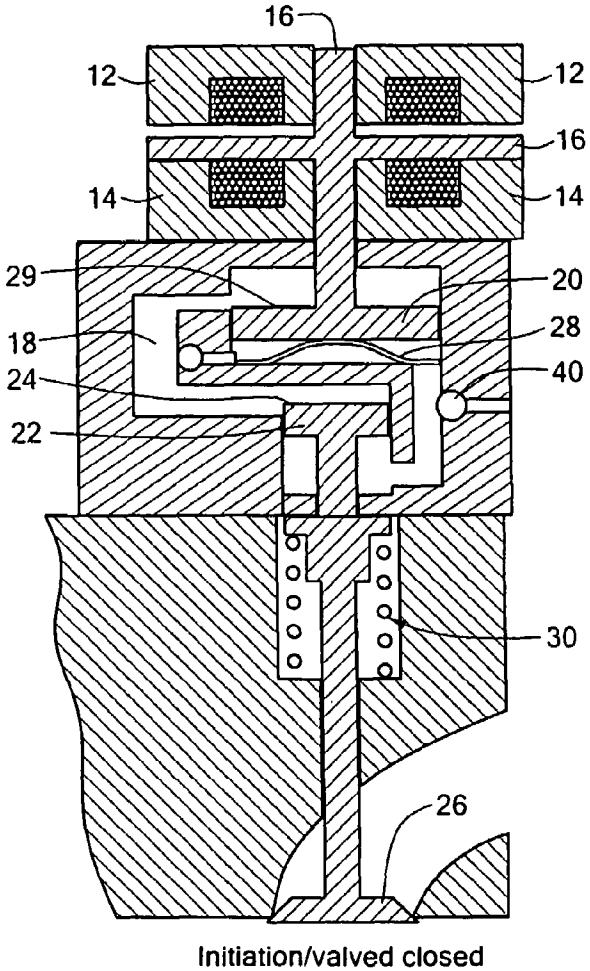
FIGS. 3A–3D show positions of elements in the electronic valve actuator of FIG. 2 at various stages in the operation of such actuator.
Figure 3A:
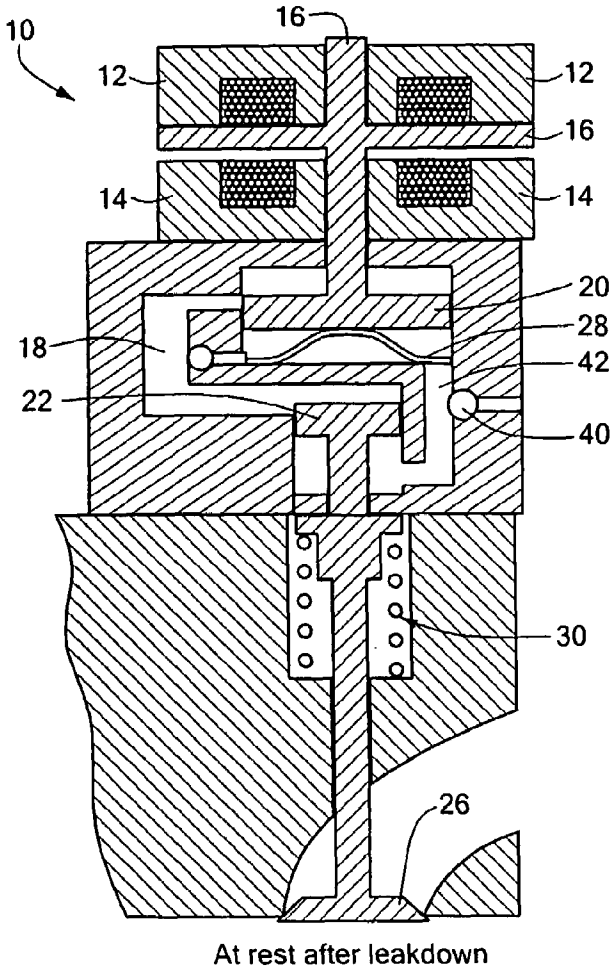
Figure 3D:
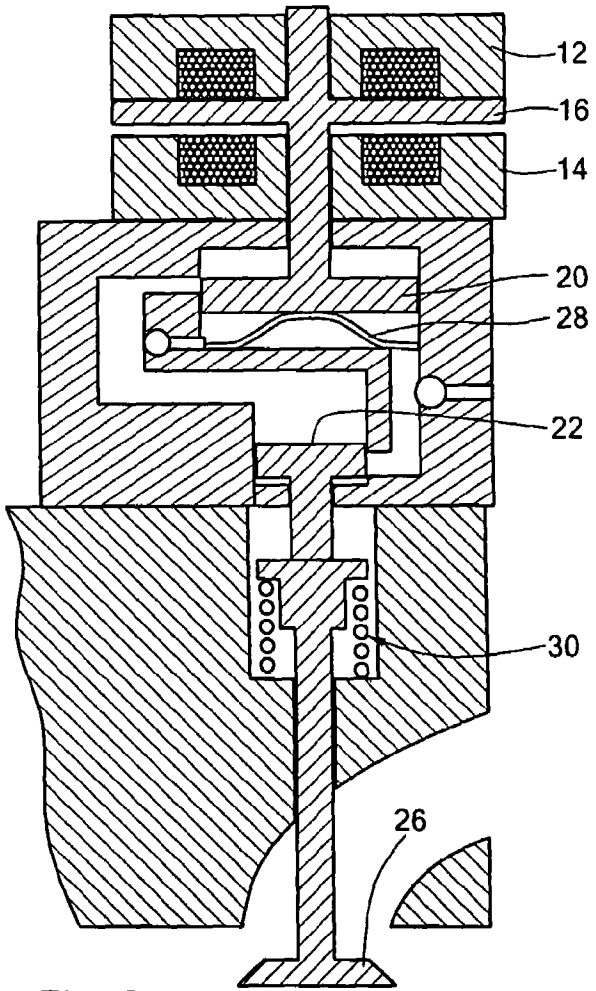

The condition of the electronic valve actuator 10 at rest after hydraulic fluid leakdown is shown in FIG. 3A.

During a startup sequence, the electromagnet coil 14 is activated and thus used to pull the armature 16 downward, as shown in FIG. 3B. This creates pressure difference between the left and right inner cavities 18, 42 and opens the check valve 43. The fluid then transfers from the right inner cavity 42 to the left inner cavity 18. This thereby compresses the upper spring 28. At this point the actuator is prepared for normal operation.

Figure 3C:
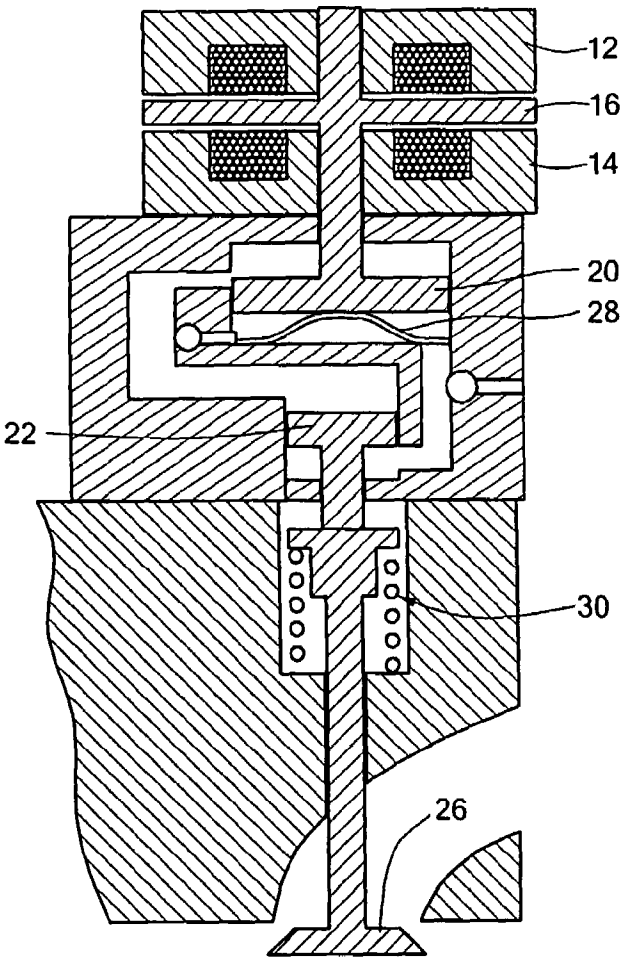

Next, the lower electromagnet coil 14 is de-energized and the upper spring 28 urges the armature 16 and upper piston 20 upward. This increases the pressure on the upper-side 29 of the upper piston 20, causing a pressure increase to the fluid in cavity 18. This pressure urges lower piston 24 to move downward and compresses the lower, valve spring 30, as shown in FIG. 3C. At some time during this process, the upper electromagnet coil 12 is energized, as shown in FIG. 3C, to thereby hold the upper and lower springs 28, 30 in expansion and compression, respectively. At this time, the upper armature piston 20 becomes hydraulically locked, travel stops, and the valve 26 is held in the open position.

Conversely, the upper electromagnet coil 12 can be de-energized and the lower electromagnet coil 14 can be energized to reverse the process and close the valve 26, as described above in connection with FIG. 3B.

Figure 1:
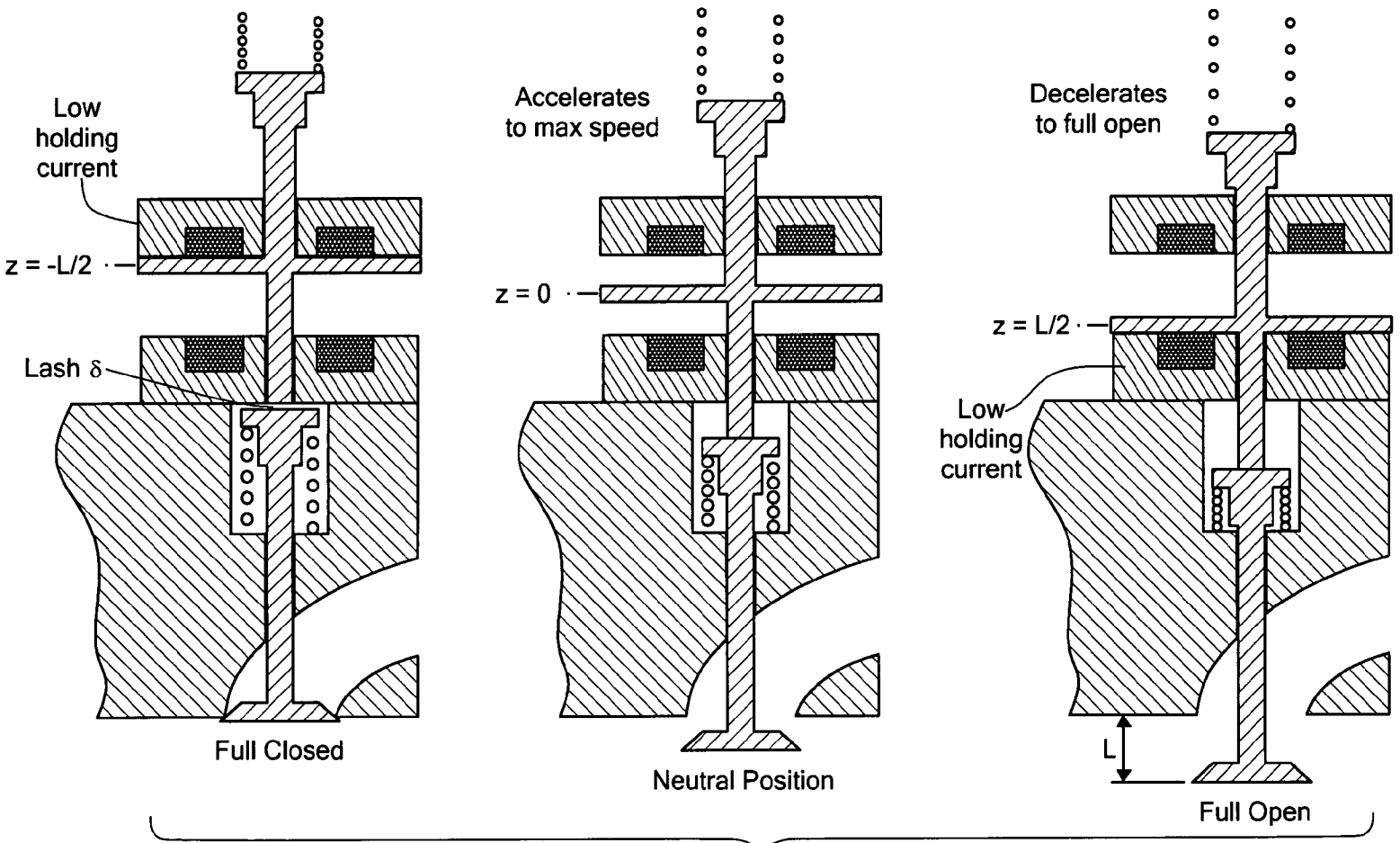
FIG. 1 PRIOR ART
FIG. 1 is a conventional electronic valve actuator.

It is noted that the distance traveled by the lower piston 22 is a factor K times the distance traveled by the upper piston, here K is the amplification gain and is the ratio of the surface area of the lower piston 22 to the surface area of the upper piston 28, i.e., K=A2/A1. Thus, here, for example, the surface area of the upper piston 20 is twice the surface are of the lower piston 22 (i.e., K=2). Thus, when the upper piston moves downward a distance L/2 the valve moves downward a distance L. Thus, the air gap between the armature plate 16 and the electromagnet 12 is reduced by a factor of 2 in this example compared with a linear (i.e., direct acting) system of FIG. 1.

During normal operation, proper design of the of the spring preloads 28, 30, damping forces, and peak magnetic forces ensures that the pressure in the left inner cavity 18 is greater than the pressure in the right inner cavity 42 during dynamic opening and closing transitions and when the valve 26 is statically held open. It is noted that the spring 28 has a stiffness approximately greater than that of the spring 30 by the amplification gain, K, to achieve a balanced state at the half lift condition. These, together with the design of the sizes of pistons 20, 22 and clearances, ensures that the proper volume of fluid is trapped in the inner chamber 18 to provide natural lash adjustment due to any thermal growth of the engine valve 26. When the valve 26 is in the closed position, the check valve 40 and feed hydraulic fluid (e.g., engine motor oil) provide enough flow via check valve 43 to make up for the small leakage through the annular spaces defined by the upper and lower piston 20, 22 clearances. If for example, the leakage of fluid reduces the left inner chamber 18 pressure to a value below the right inner chamber 42, the check valve 43 opens to fill the left inner chamber 18 with the correct volume of hydraulic fluid. If for example, the leakage of fluid reduces the right inner chamber 42 pressure to a value below the feed pressure, the check valve 40 opens to make to fill the right inner chamber 42 with the correct volume of hydraulic fluid.

A number of embodiments of the invention have been described. Nevertheless, it will be understood that various modifications may be made without departing from the spirit and scope of the invention. For example, while in the embodiment described above the first wall portion of the first one of the pair of pistons has a surface area greater than the surface area of the second wall portion of the second one of the pair of pistons the first wall portion may have a surface area the less than the surface area of the second wall portion for applications where force amplification is desired or equal in area where a direct relationship is desired.

Accordingly, other embodiments are within the scope of the following claims.

What is claimed is:

1. The electronic valve actuator An electronic valve actuator, comprising:

an armature;

a valve;

a coupler for coupling the armature to the valve with motion of the armature in one direction moving the valve in a different direction; and, wherein the coupler is a hydraulic coupler.

2. The electronic valve actuator recited in claim 1 including an electromagnet coupled to the armature.

3. An electronic valve actuator, comprising:

an electromagnet;

an armature disposed adjacent to the electromagnet;

a fluid-containing chamber having:

a first piston providing a first wall portion of the chamber; and a second piston providing a second wall portion of the chamber;

wherein the first piston is coupled to the armature and the second piston is coupled to a valve; and wherein activation of the electromagnet moves the first piston in a first direction, such motion of the first piston in the first direction driving fluid in the chamber to move the second piston in an opposite direction.

4. The actuator recited in claim 3 wherein the first wall portion has a surface area different from the surface area of the second wall portion.

5. An electronic valve actuator, comprising:

a pair of electromagnets;

an armature disposed in a magnetic field produced by the pair of electromagnets;

a fluid-containing chamber having:

a first piston providing a first wall portion of the chamber; and a second piston providing a second wall portion of the chamber,; and wherein the first piston is coupled to the armature and the second piston is coupled to a valve;

a pair of springs, wherein the armature and the first one of the pair of pistons coupled thereto are disposed to move in the first direction upon activation of a first one of the pair of electromagnets thereby compressing a first one of the pair of springs, movement of the first one of the pair of pistons causing fluid to move the second one of the pistons in the second direction thereby expanding the second one of the pair of springs, the first and second pair of the springs being held in compression and expansion, respectively, until deactivation of the first one of the electromagnets, the first one of the pair of springs being disposed to expand after deactivation of the first one of the electromagnets thereby urging the first one of the pair of pistons to move in the second direction, movement of the first one of the pistons in the second direction resulting in fluid in the chamber urging the second piston to move in the first direction resulting in expansion and compression of the first and second springs, respectively, the first and second springs being held in expansion and compression, respectively, until deactivation of the first one of the pair of electromagnets.

6. The actuator recited in claim 5 wherein the first wall portion has a surface area different from the surface area of the second wall portion.

7. The electronic valve actuator recited in claim 5 including a valve disposed in the wall of the fluid-containing chamber for enabling such chamber to receive fluid when pressure of such chamber is lower than pressure from engine feed lines and to inhibit removal of such fluid from the chamber when pressure of such chamber is greater than pressure from engine feed lines.

8. The electronic valve actuator recited in claim 7 including a second fluid-containing chamber providing a conduit for fluid therein to pass between an outer surface portion of the first piston and an outer surface portion of the second piston as the first and second pistons move in response to activation of the first and second ones of the pair of electromagnets.

9. The electronic valve actuator recited in claim 8 wherein the fluid in the second chamber passes to the first-mentioned fluid-containing chamber through a valve.

10. The actuator recited in claim 5 wherein the first wall portion has a surface area different from the surface area of the second wall portion.

11. An actuator, comprising:

a source for moving a body;

a fluid-containing chamber having:

a first piston providing a first wall portion of the chamber; and a second piston providing a second wall portion of the chamber;

wherein the first piston is coupled to the source and the second piston is coupled to an output member; and wherein activation of the source moves the first piston in a first direction, such motion of the first piston in the first direction driving fluid in the chamber to move the second piston in an opposite direction.

* * * * *